US009520105B2

(12) United States Patent
Shi et al.

(10) Patent No.: US 9,520,105 B2
(45) Date of Patent: Dec. 13, 2016

(54) POWER SAVINGS FOR DISPLAY PANELS

(75) Inventors: Jun Shi, San Jose, CA (US); Akihiro Takagi, San Mateo, CA (US); Robert J. Brennan, San Mateo, CA (US); Seh W. Kwa, Saratoga, CA (US); Yanli S. Zhang, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 1165 days.

(21) Appl. No.: 12/459,424

(22) Filed: Jun. 30, 2009

(65) Prior Publication Data

US 2010/0328333 A1 Dec. 30, 2010

(51) Int. Cl.

| | |
|---|---|
| ***G09G 3/36*** | (2006.01) |
| ***G09G 5/10*** | (2006.01) |
| ***G09G 3/34*** | (2006.01) |

(52) U.S. Cl.

CPC ..... *G09G 5/10* (2013.01); *G09G 3/342* (2013.01); *G09G 2320/103* (2013.01); *G09G 2330/021* (2013.01); *G09G 2360/16* (2013.01)

(58) Field of Classification Search

USPC ..... 345/102

See application file for complete search history.

(56) References Cited

U.S. PATENT DOCUMENTS

| | | | | |
|---|---|---|---|---|
| 7,389,432 | B2 | 6/2008 | Chandley et al. | |
| 2005/0052446 | A1 | 3/2005 | Plut | |
| 2005/0270265 | A1 | 12/2005 | Plut | |
| 2006/0044254 | A1 | 3/2006 | Kirk | |
| 2006/0087502 | A1 | 4/2006 | Karidis et al. | |
| 2006/0101293 | A1 | 5/2006 | Chandley et al. | |
| 2006/0132474 | A1 | 6/2006 | Lam | |
| 2006/0262077 | A1 * | 11/2006 | Terasaka | 345/102 |
| 2007/0222744 | A1 * | 9/2007 | Okita et al. | 345/102 |
| 2008/0055228 | A1 * | 3/2008 | Glen | 345/102 |
| 2010/0073276 | A1 * | 3/2010 | Koike et al. | 345/102 |
| 2010/0149197 | A1 | 6/2010 | Plut | |
| 2011/0316902 | A1 * | 12/2011 | Onishi et al. | 345/690 |

FOREIGN PATENT DOCUMENTS

WO 2012/087677 A2 6/2012

OTHER PUBLICATIONS

Hojun, et al., A Backlight Power Management Framework for Battery-Opera Ted Multimedia Systems, Embedded Systems for Real-Time Multimedia, IEEE Design & Test of Computers, Sep.-Oct. 2004, pp. 2-10.

Partbasarathy, et al., Energy-Aware User Interfaces and Energy-Adaptive Displays, Published by the IEEE Computer Society, Mar. 2006, pp. 31-38.

International Search Report and Written Opinion receive for PCT Patent Application No. PCT/US2011/064662, mailed on Jul. 31, 2012, 9 pages.

Non Final Office Action received for U.S. Appl. No. 12/974,135, mailed on Sep. 21, 2012, 15 pages.

Final Office Action received for U.S. Appl. No. 12/974,135, mailed on Jan. 17, 2013, 14 pages.

* cited by examiner

*Primary Examiner* — Roy Rabindranath

(74) *Attorney, Agent, or Firm* — International IP Law Group, P.L.L.C.

(57) ABSTRACT

In some embodiments one or more areas of interest to a user of a display screen are determined. Portions of the display screen other than the one or more areas of interest are dimmed. Other embodiments are described and claimed.

22 Claims, 5 Drawing Sheets

POWER SAVINGS FOR DISPLAY PANELS

TECHNICAL FIELD

The inventions generally relate to power savings for display panels.

BACKGROUND

Manufacturers of laptop and desktop computers have tried many different ways to improve battery life. In order to allow battery life to last longer, manufacturers have partially or completely powered down various parts of the computer in certain circumstances. For example, the Central Processing Unit (CPU) and/or portions or all of the chipset of the computer can be partially or completely powered down under certain circumstances. However, it has become more and more important in laptop computers as well as other types of computers and other electronic devices to try to maintain an even lower power usage so that battery life and/or power usage are minimized as much as possible.

BRIEF DESCRIPTION OF THE DRAWINGS

The inventions will be understood more fully from the detailed description given below and from the accompanying drawings of some embodiments of the inventions which, however, should not be taken to limit the inventions to the specific embodiments described, but are for explanation and understanding only.

DETAILED DESCRIPTION

Figure 1:
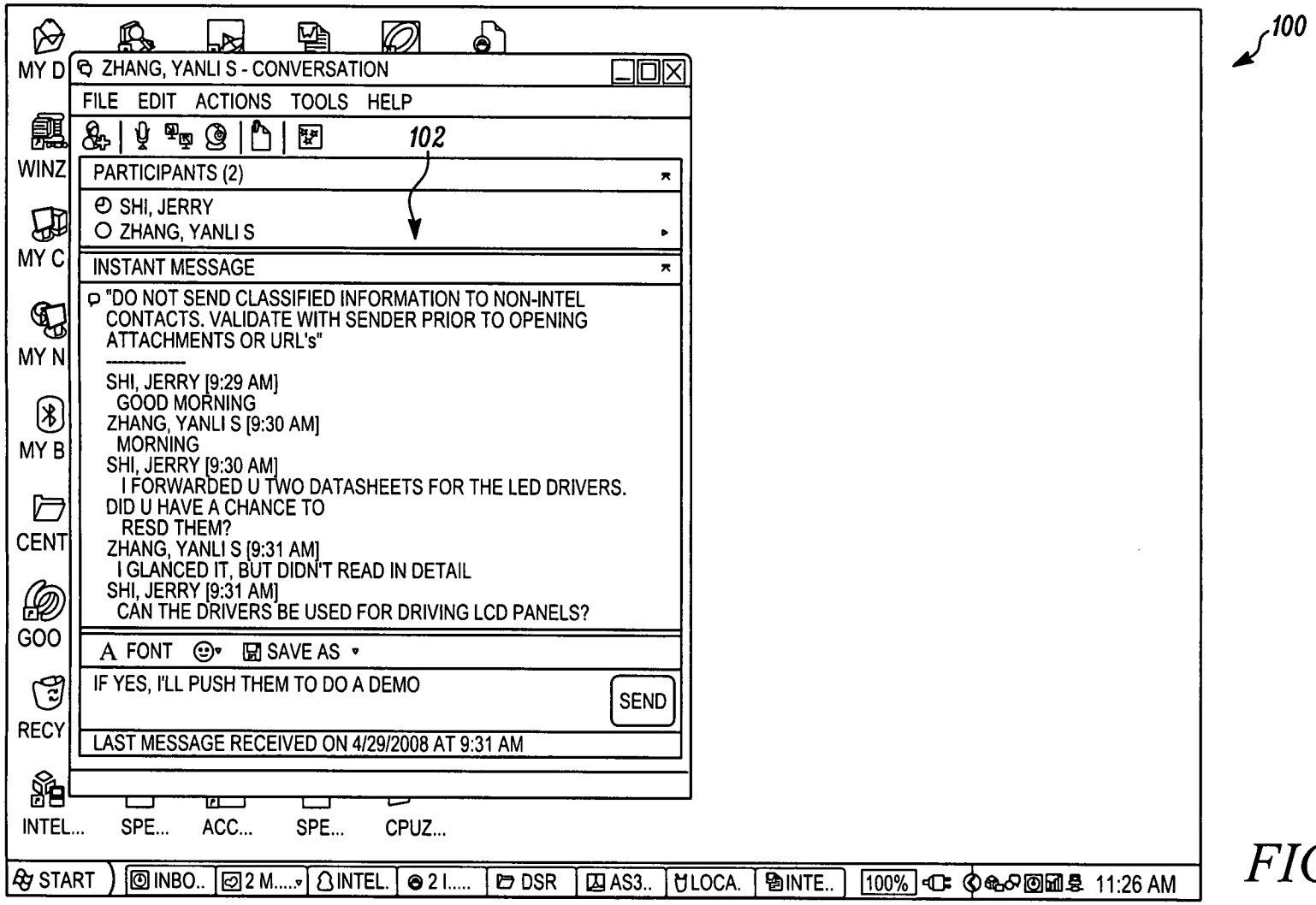
FIG. 1 illustrates a display screen according to some embodiments of the inventions.

Some embodiments of the inventions relate to power savings for display panels.

In order to use less power and/or to make battery life of a computer or other electronic device (for example, a laptop computer) last longer, many parts of the device may be used in such a manner that they are partially or completely powered down in certain circumstances. The backlight of the display panel often consumes a relatively high power compared to other portions of a laptop, for example. However, no laptops previously have partially dimmed the backlight of the display panel.

In photography, it is a common idea that each picture should have one principal idea, topic, or center of interest to which the viewer's eyes are attracted. Subordinate elements within the picture often support and focus attention on the principal feature so that it alone is emphasized in the picture. A picture without a dominant center of interest or with more than one dominant center of interest is typically puzzling to a viewer. In such a case, the viewer can become confused, and wonders what the picture is really about. When the picture has one and only one dominant point of interest, the viewer typically understands the picture much better. This principal can be extended to the display of a computer.

In some embodiments, the display of a computer such as a laptop computer (and/or other electronic device) shows an area of areas of interest in a normal manner while dimmer other areas of the display, resulting in power savings. When people view the screen of a computer or other electronic device they often do not even look at the entire display screen. For example, if more than one window is opened on a computer screen, areas of the wallpaper of the computer are exposed. For the areas that are not of interest (and/or currently of interest) to the user, the display panel backlight can be dimmed using, for example, local dimming techniques. Whether the screen is idle or active, according to some embodiments, the areas that are not of interest may be dimmed under certain conditions. For example, according to some embodiments, if a user is flipping pages on a file of an Adobe acrobat window, but the window size and position do not change for a certain amount of time, other areas can be dimmed. Particularly with the recent increase in the size of display panels, more and more opportunities exist for dimming areas that are not of interest to the user (and/or not currently of interest to the user). In some embodiments, an area of interest of a display panel can be determined and/or defined, and frame update occurs only in that area of the display panel and not in other areas (for example, if the other areas are dimmed, and/or remain the same without any additional updating).

According to some embodiments, the area of interest is detected, address comparison is made to see which areas of the display are out of interest, and information is exchanged, for example, between the Operating System and a backlight control unit that performs backlight control of a display panel. This information exchange is performed, for example, in some embodiments using a driver located in a middle layer between the hardware and an application or operating system software.

For example, a display panel is divided into segments, where each segment can be individually dimmed. In some embodiments, a segment bitmap in a table is defined to show which segment or segments is/are out of interest and can be dimmed. The segment table is maintained, for example, using an Operating System driver or using the Operating System itself. When an active window fully or partially occupies a segment, the corresponding cell in the table is set to a value indicating that the segment should not be dimmed. When a segment is not used by a window and the wallpaper fully covers that segment, for example, the corresponding cell in the table is set to a value indicating that the segment should be dimmed.

In some embodiments, an area of interest is defined where frame updates can occur, and other areas of the display are defined so that no frame updates occur. When the display screen has been idle for a certain period of time, the image on the display screen shows the area of interest and dims other areas of the display, for example. If the display screen remains idle, then the whole display screen can be dimmed, or the area of interest may be maintained, according to various embodiments. In some embodiments, these features may be programmed (for example, by a user).

In some embodiments, a user defines an interest level for each application. If a first window with a lower interest level is covered more than a certain amount (for example, more than 50%) by a second window with a higher interest level, then one or more segments covered by the first window with the lower interest level may be dimmed. Similarly, if the first window has a high interest level, then segments of that first window won't be dimmed even if another window covers most of it. In some embodiments, such interest levels can be programmed and changed by a user at any time depending on the needs of the user. In some embodiments, for areas where the backlight is completely dimmed, no display data is needed to be accessed and transferred from the display buffer to the display panel, for example. Black pixels may be inserted at the last stage of display before the display panel.

In some embodiments, power saving and/or battery life improvement is implemented on a computer (for example, a desktop computer or a laptop computer) or other types of electronic devices having a display.

FIG. 1 illustrates a display screen 100 according to some embodiments. In some embodiments display screen 100 displays an area of interest 102. Area of interest 102 could be, for example, a chat session in which a user (for example, a user of a computer such as a laptop computer or a desktop computer) is chatting with a remote user of another device. In such a scenario, the user's interest is focused on the chatting window 102 for a period of time, and the user is not interested in viewing any other areas of the display screen 100, and other areas than chatting window 102 are out of the user's attention and interest for a while.

In some embodiments, display panels that have vertically segmented backlights may be used. The panel backlights can be powered down partially when a situation is well suited, such as the scenario described in reference to FIG. 1.

Figure 2:
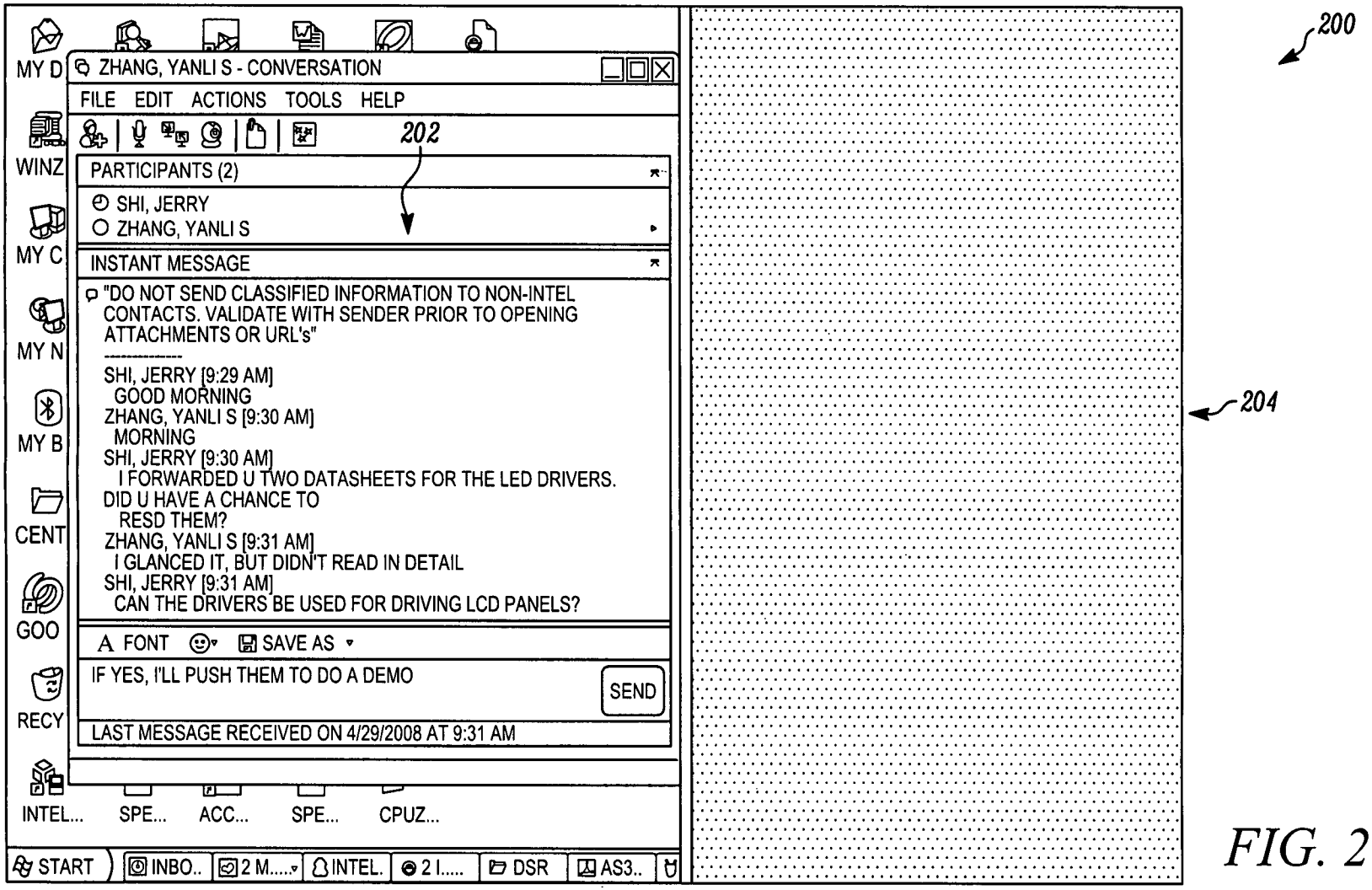
FIG. 2 illustrates a display screen according to some embodiments of the inventions.

FIG. 2 illustrates a display screen 200 according to some embodiments. In some embodiments, display screen 200 displays an area of interest 202, which may be similar to area of interest 102 in FIG. 1. In any case, in some embodiments, display panel 200 has vertically segmented backlights that are powered down, resulting in an area 204 of display panel 200 which is dimmed. In FIG. 2, the right part of the screen of area 204 is dimmed for power saving, for example, using vertically segmented backlights. In some embodiments, the icons and minimized windows included on the bottom right of the screen (for example, as shown at the bottom right of screen 100 in FIG. 1) can be moved to a portion of the screen 200 that is not dimmed (for example, in some embodiments, to the bottom left of screen 200).

Figure 3:
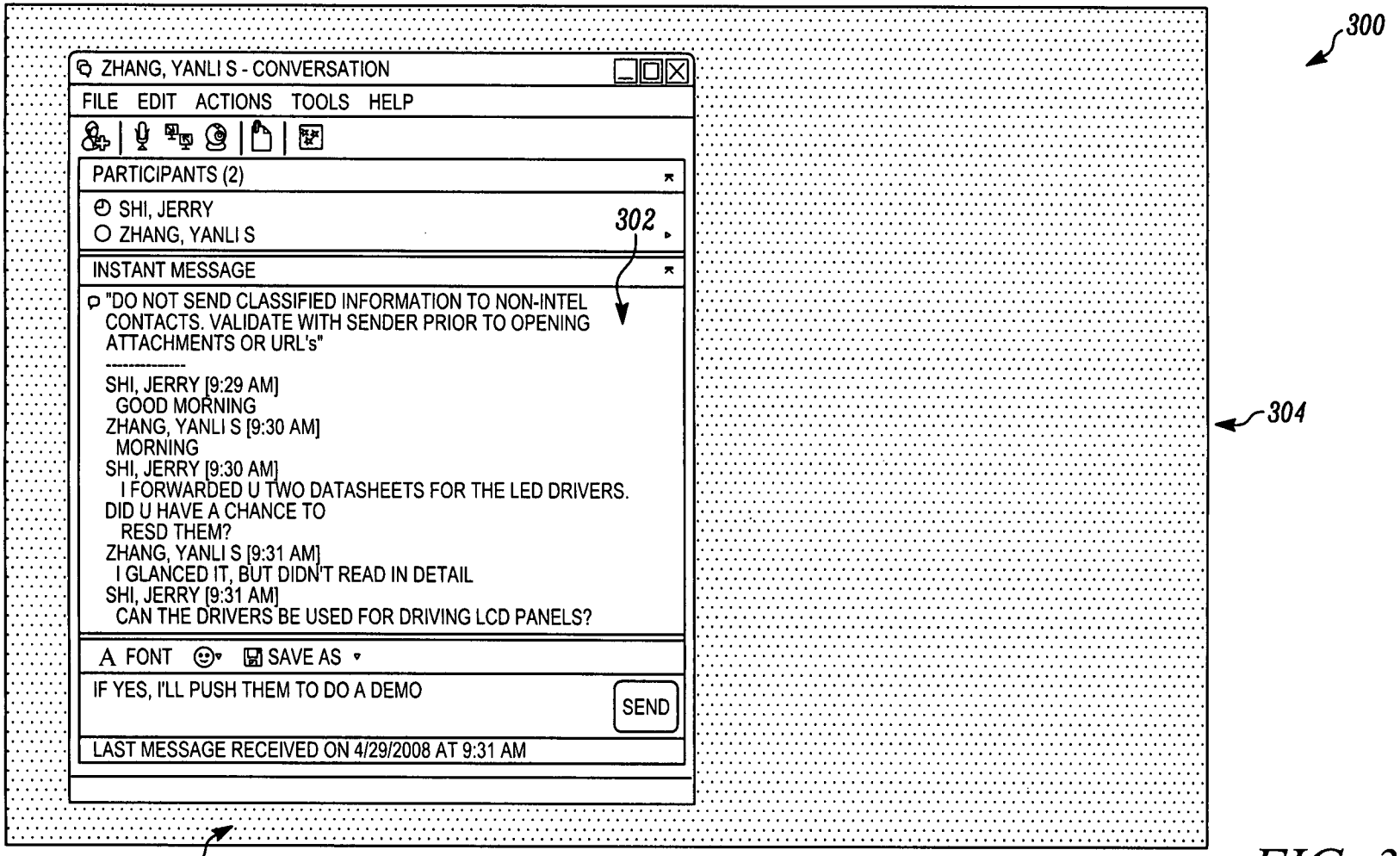
FIG. 3 illustrates a display screen according to some embodiments of the inventions.

FIG. 3 illustrates a display screen 300 according to some embodiments. In some embodiments, display screen 300 displays an area of interest 302, which may be similar to area of interest 102 in FIG. 1 and/or area of interest 202 in FIG. 2. In FIG. 3, the area 304 of the screen 300 that does not include area of interest 302 is dimmed for power saving, for example. In some embodiments, a segment bitmap table may be used to identify which areas 304 of the display screen 300 are to be dimmed, for example.

In some embodiments, power saving is implemented using backlights such as segmented backlights (for example, vertically segmented backlights). According to some embodiments, the backlights of a display panel may be partially and/or opportunistically dimmed. For example, a dimming policy, detection of an area of interest, Operating System and/or driver support, and/or hardware support may be used.

In some embodiments, a user uses a window having a size smaller than the full display screen, and allows partial backlight dimming to be implemented. For example, a user wishes to watch a video clip (for example, from YouTube) within a small window for a long period of time, and allows the unattended portion of the screen (for example, all of the screen not within the small window used to watch the video clip) to be dimmed to save power and/or battery power. In this scenario, the dimming policy and detection of the area of interest are relatively easy, since the user knows the size and location of the window to be used to watch the clip. In some embodiments, the level of dimming can be defined by the user and/or predefined for or by the user.

In some embodiments, a user allows for partial backlight dimming of the display screen, but does not define the area of interest. In this scenario, the system detects when and where to dim the backlights. This is more challenging than the scenario where the area of interest is defined by the user, but is implemented according to some embodiments. The partial dimming is enabled, but the area of interest is not predefined, and the system defines the area of interest on the fly. In some embodiments, a driver for controlling the backlight determines where to dim the display screen.

Figure 4:
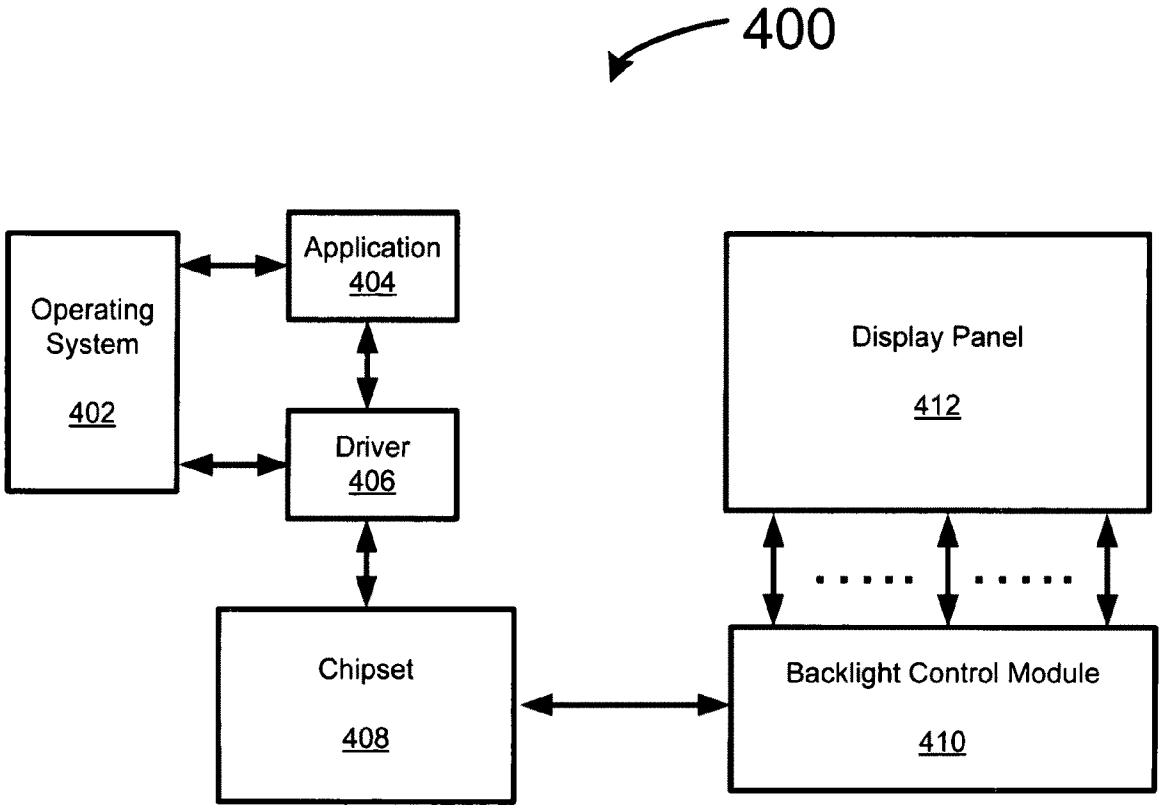
FIG. 4 illustrates a system according to some embodiments of the inventions.

FIG. 4 illustrates a system 400 according to some embodiments. System 400 includes an Operating System 402, a software application 404, a driver 406, a chipset 408, a backlight control module 410, and a display panel (for example, with segmented backlights) 412. In some embodiments, Operating System 402 is a standard operating system with no further modifications to perform segmented dimming of backlights. Application 404 retrieves from the Operating System 402 information on the size and location of opened windows, and passed this information to the driver 406. The driver 406 receives this information and uses it to determine which segment or segments of the backlight of display panel 412 should be dimmed. The chipset 408, which in some embodiments, is a portion of a chipset such as a Platform Controller Hub (PCH), sends out via a bus (for example, SMBus or an equivalent thereof) the hardware commands to the backlight control module 410. The backlight control module 410 then dims the targeted segment or segments of the backlight of the display panel 412.

Figure 5:
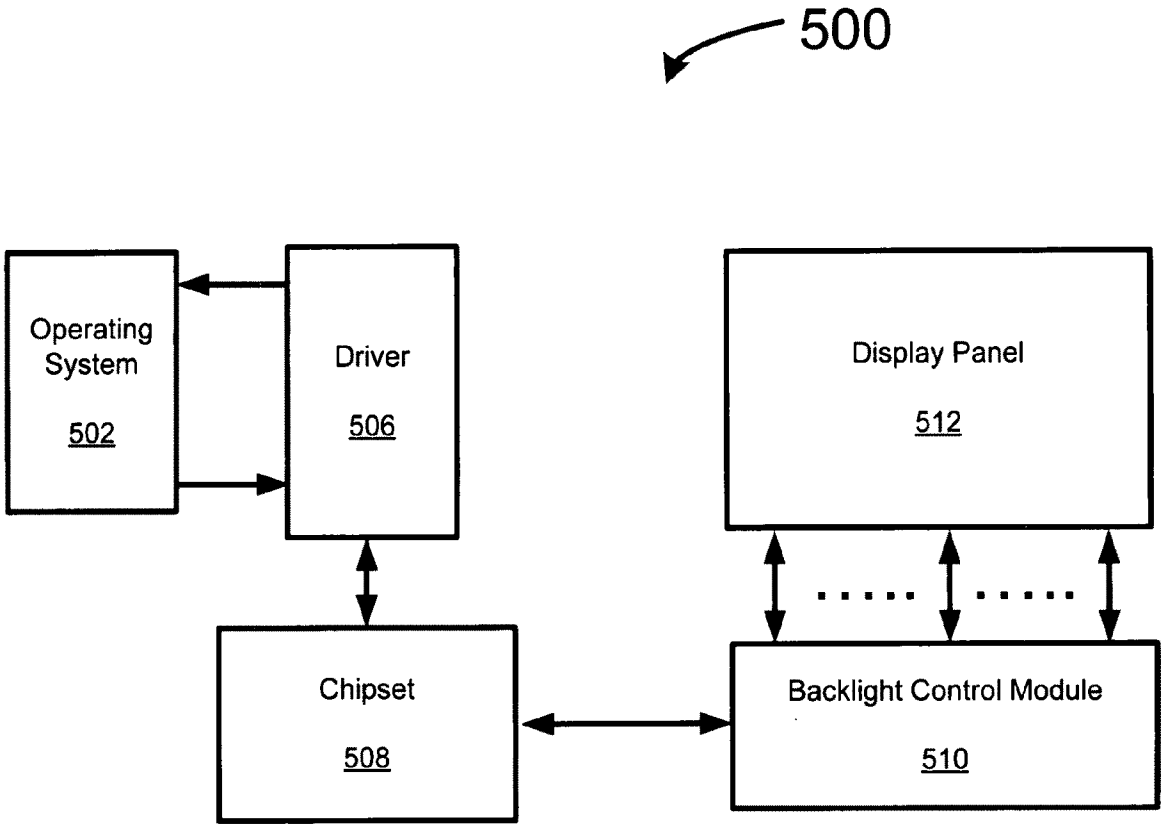
FIG. 5 illustrates a system according to some embodiments of the inventions.

FIG. 5 illustrates a system 500 according to some embodiments. System 500 includes an Operating System 502, a driver 506, a chipset 508, a backlight control module 510, and a display panel (for example, with segmented backlights) 512. In some embodiments, driver 506 registers with the Operating System 502. The Operating System 502 includes functionality to periodically pass to driver 506 information about the size and location of any window being used by a user. The driver 506 receives this information from Operating System 502 and uses it to determine which segment or segments of the backlight of display panel 512 should be dimmed. The chipset 508, which in some embodiments, is all of a chipset or a portion of a chipset such as a PCH, sends out via a bus (for example, SMBus or an equivalent thereof) the hardware commands to the backlight control module 510. The backlight control module 510 then dims the targeted segment or segments of the backlight of the display panel 512. In some embodiments, the system 500 of FIG. 5 consumes less power than the system 400 of FIG. 4, since the application 404 of FIG. 4 needs to run all the time. This consumes more Central Processing Unit (CPU) power, even though the amount of that power is very small.

In some embodiments, the display panel (for example, display panel 100, 200, 300, 412, and/or 512) is a segmented backlight panel and/or a vertically segmented backlight panel. In some embodiments, the display panel (for example, display panel 100, 200, 300, 412, and/or 512) is an Organic Light Emitting Diode (OLED) panel. In some embodiments using an OLED panel without backlight, similar concepts are implemented, for example, in which the system controls the brightness of each pixel, for example.

In some embodiments, certain video playback conditions may be improved. For example, if video content is, for example, 4:3 video playing on a Liquid Crystal Display (LCD) with a wide aspect ratio, a video player application is implemented according to some embodiments in which black borders are displayed at the side of the display screen. In such embodiments, the video player application can report to a graphic driver is borders are necessary. Such an implementation saves power relative to implementations using a full screen playback mode.

In some embodiments, for example, using a laptop as a portable DVD player is more feasible, since power saving and battery life improvements are implemented.

Although some embodiments have been described herein as being implemented in certain ways, according to some embodiments these particular implementations may not be required. Although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

In the description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other form of propagated signals (e.g., carrier waves, infrared signals, digital signals, the interfaces that transmit and/or receive signals, etc.), and others.

An embodiment is an implementation or example of the inventions. Reference in the specification to "an embodiment," "one embodiment," "some embodiments," or "other embodiments" means that a particular feature, structure, or characteristic described in connection with the embodiments is included in at least some embodiments, but not necessarily all embodiments, of the inventions. The various appearances "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Although flow diagrams and/or state diagrams may have been used herein to describe embodiments, the inventions are not limited to those diagrams or to corresponding descriptions herein. For example, flow need not move through each illustrated box or state or in exactly the same order as illustrated and described herein.

The inventions are not restricted to the particular details listed herein. Indeed, those skilled in the art having the benefit of this disclosure will appreciate that many other variations from the foregoing description and drawings may be made within the scope of the present inventions. Accordingly, it is the following claims including any amendments thereto that define the scope of the inventions.

What is claimed is:

1. A method comprising:

determining one or more areas of interest to a user of a display screen in response to a size and a location of one or more windows opened by the user;

dimming portions of the display screen other than the one or more areas of interest by dimming a backlight segment of the display screen to reduce power consumption of the display screen; and not performing frame updates in areas outside the area of interest.

2. The method of claim 1, wherein the dimming includes dimming vertically segmented backlights of the display screen.

3. The method of claim 1, wherein the dimming includes dimming individual pixels of the display screen.

4. The method of claim 1, wherein the dimming is performed at a level in response to a defined amount of dimming.

5. The method of claim 1, wherein the determining is performed in response to one or more functions being used by the user.

6. The method of claim 1, wherein the determining is performed in response to a video playback function to be used by the user.

7. The method of claim 1, wherein the determining is responsive to a software application.

8. The method of claim 1, wherein the dimming includes dimming all portions of the display screen other than the one or more areas of interest.

9. The method of claim 1, comprising inserting black pixels in an output sent to the display screen corresponding to the areas outside the area of interest.

10. An apparatus comprising:

a driver to determine one or more areas of interest to a user of a display screen in response to a size and a location of one or more windows opened by the user; and a controller to dim portions of the display screen other than the one or more areas of interest by dimming a backlight segment of the display screen to reduce power consumption of the display screen;

wherein frame updates are not performed in areas outside the area of interest.

11. The apparatus of claim 10, wherein the dimming includes dimming vertically segmented backlights of the display screen.

12. The apparatus of claim 10, wherein the dimming includes dimming individual pixels of the display screen.

13. The apparatus of claim 10, wherein the determining is performed in response to one or more functions being used by the user.

14. The apparatus of claim 10, further comprising a software application coupled to the driver.

15. The apparatus of claim 10, the controller to dim all portions of the display screen other than the one or more areas of interest.

16. The apparatus of claim 10, the apparatus to insert black pixels in an output sent to the display screen corresponding to the areas outside the area of interest.

17. An article comprising:

a readable storage medium having instructions thereon which when executed cause an electronic device to:

determine one or more areas of interest to a user of a display screen in response to a size and a location of one or more windows opened by the user; and dim portions of the display screen other than the one or more areas of interest by dimming a backlight segment of the display screen to reduce power consumption of the display screen; and not perform frame updates in areas outside the area of interest.

18. The article of claim 17, the instructions further causing the electronic device to dim individual pixels of the display screen.

19. The article of claim 17, the instructions further causing the electronic device to determine the one or more areas in response to a video playback function to be used by the user.

20. The article of claim 17, the instructions further causing the electronic device to determine the one or more areas of interest in response to a software application.

21. The article of claim 17, the instructions further causing the electronic device to dim all portions of the display screen other than the one or more areas of interest.

22. The article of claim 17, the instructions further causing the electronic device to insert black pixels in an output sent to the display screen corresponding to the areas outside the area of interest.

* * * * *